US009277774B2

(12) United States Patent
Gosse

(10) Patent No.: US 9,277,774 B2
(45) Date of Patent: Mar. 8, 2016

(54) WAISTBAND SYSTEM, METHOD AND APPARATUS

(75) Inventor: Andrew Gosse, Portland, OR (US)

(73) Assignee: Columbia Sportswear North America, Inc., Portland, OR (US)

( * ) Notice: Subject to any disclaimer, the term of this patent is extended or adjusted under 35 U.S.C. 154(b) by 172 days.

(21) Appl. No.: 13/278,094

(22) Filed: Oct. 20, 2011

(65) Prior Publication Data

US 2012/0096627 A1 Apr. 26, 2012

Related U.S. Application Data

(60) Provisional application No. 61/405,098, filed on Oct. 20, 2010.

(51) Int. Cl.
*A41D 1/08* (2006.01)
*A41D 13/05* (2006.01)

(52) U.S. Cl.
CPC ..... *A41D 1/082* (2013.01); *A41D 13/0525* (2013.01); *A41D 2600/10* (2013.01)
USPC ..... 2/227

(58) Field of Classification Search
USPC ..... 2/227, 236, 237, 220, 221
See application file for complete search history.

(56) References Cited

U.S. PATENT DOCUMENTS

| | | | | |
|---|---|---|---|---|
| 2,562,234 | A * | 7/1951 | Gottschalk | 2/117 |
| 3,737,916 | A * | 6/1973 | Grenier | 2/70 |
| 4,332,034 | A | 6/1982 | Muse | |
| 4,561,121 | A * | 12/1985 | Ehring et al. | 2/455 |
| 4,633,527 | A * | 1/1987 | Ehring | 2/22 |
| 4,843,647 | A * | 7/1989 | Phillips et al. | 2/69 |
| 5,050,244 | A | 9/1991 | Kleinman | |
| 5,351,340 | A * | 10/1994 | Aldridge | 2/108 |
| 5,402,539 | A * | 4/1995 | Hewitt | 2/227 |
| 5,675,842 | A * | 10/1997 | Schaefer | 2/237 |
| 6,108,819 | A * | 8/2000 | DeBaene et al. | 2/227 |
| 6,138,282 | A * | 10/2000 | Follese | 2/400 |
| 6,185,745 | B1 * | 2/2001 | Alger | 2/107 |
| 6,327,715 | B1 * | 12/2001 | Castiglione | 2/267 |
| 6,389,600 | B1 * | 5/2002 | Di Maio | 2/121 |
| 6,665,878 | B1 * | 12/2003 | Way | 2/84 |
| 6,684,408 | B2 * | 2/2004 | Rindle et al. | 2/108 |
| 6,735,785 | B2 * | 5/2004 | Takayama | 2/236 |
| 6,922,849 | B1 * | 8/2005 | Fedrick | 2/227 |
| 7,047,568 | B2 * | 5/2006 | Hofmann | 2/70 |
| 7,124,448 | B2 * | 10/2006 | Davenport | 2/229 |
| 7,404,214 | B2 * | 7/2008 | Woolcott et al. | 2/85 |

(Continued)

FOREIGN PATENT DOCUMENTS

| | | | | |
|---|---|---|---|---|
| DE | 3228720 | A1 * | 2/1984 | 2/456 |
| JP | 09003710 | | 1/1997 | |

*Primary Examiner* — Andrew W Collins
(74) *Attorney, Agent, or Firm* — Schwabe, Williamson & Wyatt, P.C.

(57) ABSTRACT

Embodiments provide a waistband system including a flap of material coupled to a pair of pants at or near a waistband of the pants. The flap may be rotated (e.g., folded) between an extended position in which at least a portion of the flap rises above a waistline (i.e., top edge) of the pants, and a folded down position in which the flap is substantially or completely disposed in an interior portion of the pants below the waistline. When the flap is in the extended (folded up) position, the flap may provide a user of the pants protection from snow, rain, liquids, and/or debris, above the waistline of the pants. On the other hand, the folded down position may provide more comfort and/or aesthetic appeal.

18 Claims, 12 Drawing Sheets

(56) References Cited

U.S. PATENT DOCUMENTS

| | | | | |
|---|---|---|---|---|
| D595,029 | S * | 6/2009 | Diermayer et al. | D2/742 |
| 7,596,816 | B1 * | 10/2009 | Henry et al. | 2/227 |
| 7,874,019 | B2 * | 1/2011 | Woolcott et al. | 2/87 |
| 7,900,276 | B2 * | 3/2011 | Hendrickson et al. | 2/237 |
| 2005/0022285 | A1 * | 2/2005 | Berns et al. | 2/69 |
| 2005/0044605 | A1 * | 3/2005 | Hofmann | 2/69 |
| 2005/0114979 | A1 * | 6/2005 | Woolcott et al. | 2/69 |
| 2005/0246820 | A1 * | 11/2005 | Davenport | 2/227 |
| 2006/0010571 | A1 * | 1/2006 | Oakley | 2/227 |
| 2007/0266472 | A1 * | 11/2007 | DuFaux | 2/80 |
| 2008/0092265 | A1 * | 4/2008 | Gage et al. | 2/69 |
| 2008/0276344 | A1 * | 11/2008 | Woolcott et al. | 2/87 |
| 2009/0049583 | A1 | 2/2009 | Stones | |
| 2010/0043118 | A2 * | 2/2010 | Woolcott et al. | 2/87 |
| 2011/0041234 | A1 * | 2/2011 | Blackford | 2/97 |

* cited by examiner

WAISTBAND SYSTEM, METHOD AND APPARATUS

CROSS REFERENCE TO RELATED APPLICATIONS

The present application claims priority to U.S. Provisional Patent Application No. 61/405,098, filed Oct. 20, 2010, entitled "Fold-up Waistband System, Method and Apparatus," the entire disclosure of which is hereby incorporated by reference in its entirety.

TECHNICAL FIELD

Embodiments of the present disclosure relate generally to outerwear, and in particular to methods and apparatuses of utilizing a fold-up/down waistband coupled to outerwear pants such as ski pants.

BACKGROUND

Outerwear pants are widely used when engaged in activities in the snow or rain, such as skiing, snowboarding, and mountain climbing. The pants are designed to protect the user from outside elements, such as snow, rain, and dirt. Some outerwear pants have special features to prevent outside elements, e.g. snow, from coming in contact with the user's skin or inside layer of clothing. For instance, many outerwear pants have a higher waistband or a bib design that extends the coverage of the pants further up the torso of the user. This added coverage is especially important in the case of a fall, when snow or rain may reach the upper body of the user and enter the interior of the pants. However, the higher waistline and/or bib design in outerwear pants can be uncomfortable and/or aesthetically unpleasant, and the added protection from the elements may not be needed in all situations, such as when the user is not currently engaged in outdoor activities.

BRIEF DESCRIPTION OF THE DRAWINGS

Embodiments will be readily understood by the following detailed description in conjunction with the accompanying drawings. Embodiments herein are illustrated by way of example and not by way of limitation in the figures of the accompanying drawings.

DETAILED DESCRIPTION OF EMBODIMENTS

Figure 1A:
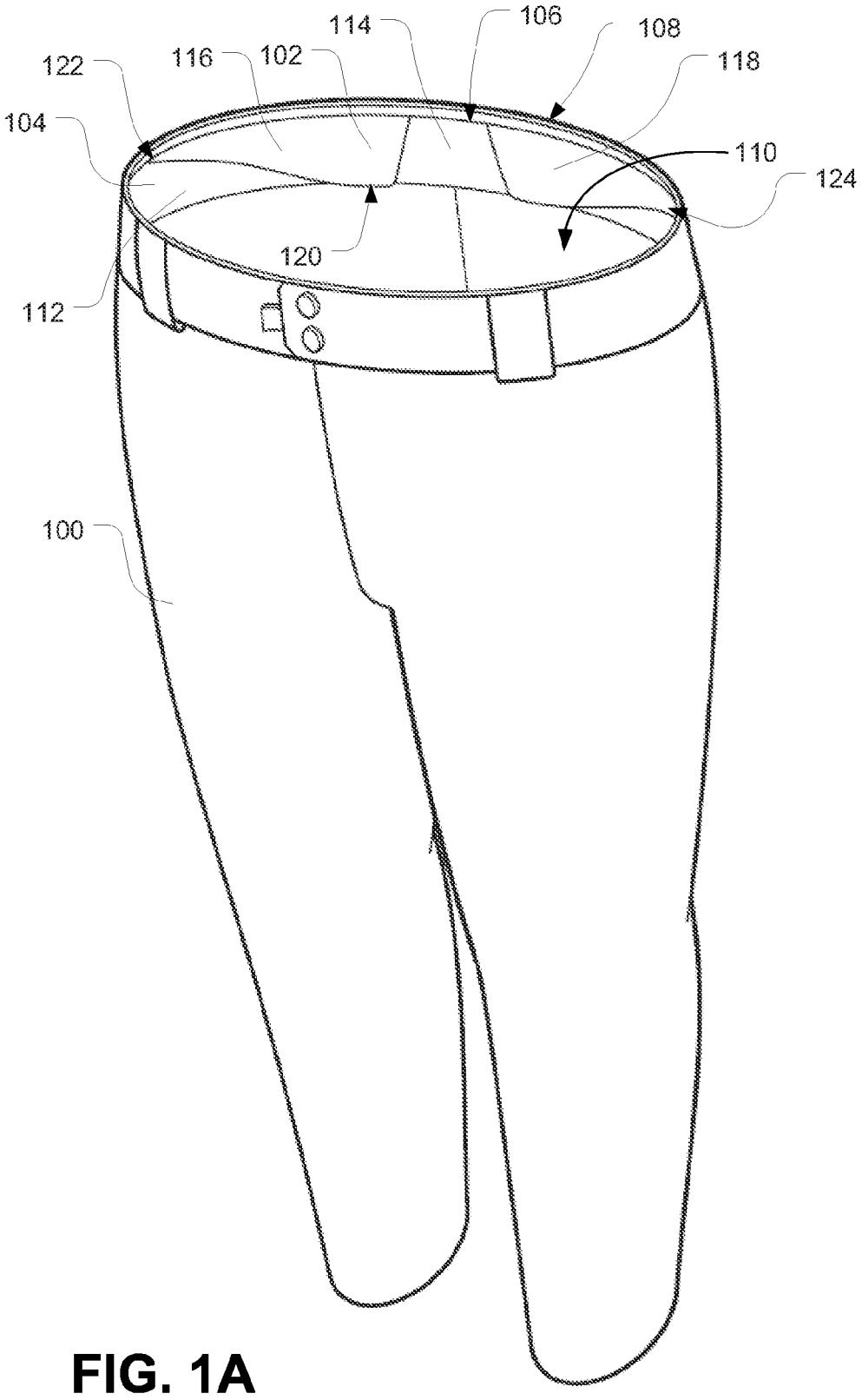
FIGS. 1A-C illustrate various views of an example of a pair of pants including a fold-up waistband system with a flap of the fold-up waistband system in a folded down position, including: (A) a perspective view; (B) a front view; and (C) a rear view, in accordance with various embodiments.

In the following detailed description, reference is made to the accompanying drawings which form a part hereof, and in which are shown by way of illustration embodiments in which the disclosure may be practiced. It is to be understood that other embodiments may be utilized and structural or logical changes may be made without departing from the scope of the present disclosure. Therefore, the following detailed description is not to be taken in a limiting sense, and the scopes of embodiments, in accordance with the present disclosure, are defined by the appended claims and their equivalents.

Various operations may be described as multiple discrete operations in turn, in a manner that may be helpful in understanding embodiments herein; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments herein.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the phrases "in an embodiment," or "in embodiments," which may each refer to one or more of the same or different embodiments. Furthermore, the terms "comprising," "including," "having," and the like, as used with respect to embodiments herein, are synonymous.

In various embodiments, a waistband system may include a flap of material coupled to a pair of pants at or near a waistband of the pants. The flap may be moved between an extended position in which at least a portion of the flap extends above a waistline (i.e., top edge) of the pants, and a folded down position in which the flap is substantially or completely disposed in an interior portion of the pants below the waistline. When the flap is in the extended position, the flap may provide a user of the pants protection from matter, such as snow, rain, other liquids, and/or debris, contacting the user above the waistline of the pants. On the other hand, the folded down position may provide more comfort and/or aesthetic appeal. Accordingly, the panel may be extended (folded up) to provide extra protection for the user when desired, and may be folded down when the extra protection is not needed.

In various embodiments, the pants may be any suitable type of pants configured to be worn by a user. The pants may include leg portions configured to substantially cover the legs of the user. In some embodiments, the pants may be outerwear pants designed to protect the user from outside elements, such as rain, snow, water, and/or debris. The waistband system may be particularly useful when the user is engaged in outdoor activities when there is precipitation, such as snow and/or rain. Furthermore, the waistband system may be particularly useful when engaged in outdoor activities where there is a chance of the user falling, such as skiing and/or snowboarding.

In various embodiments, the flap may be coupled to an interior surface of the pants (e.g., a surface of the pants in the interior portion that faces the user's body when the pants are worn). In some embodiments, the flap may be coupled at or near the waistline (top edge) of the pants. In other embodiments, the flap may be coupled to the interior surface of the pants below the waistline, such as on and/or below a waistband of the pants (i.e., a strip of material that defines the waistline of the pants and extends around the waist of the user). Having the flap coupled to the pants below the waistline may facilitate maintaining the flap below the waistline of the pants when in the folded down position. Additionally, the flap coupled below the waistline may facilitate maintaining the flap against the user's body when the flap is in the extended position, since a lower portion of the flap will be held against the user's body by the waistband of the pants.

In various embodiments, the flap may be of any desirable shape, such as generally trapezoidal, generally rounded (e.g., semi-circular), generally rectangular, etc. In various embodiments, the flap may have a length (the distance over which the flap is coupled to the pants) and a height (the distance from a top edge of the flap to the location where the flap is coupled to the pants). In some embodiments, the length of the flap may extend along only a portion of the waistline. For example, the length of the flap may be less than, equal to, and/or greater than a circumference of the waistline. In other embodiments, the length of the flap may extend along the entire length of the waistband (i.e., the length of the flap may be substantially equal to the circumference of the waistline).

In some embodiments, the flap may be centered on a back portion of the pants configured to rest on the user's back when the pants are worn. The back of the user may be particularly susceptible to intrusion by snow, water, and/or debris in the event of a fall, so it may be particularly desirable for the flap to protect the back of the user. In some embodiments, the flap may extend only along the portion of the waistline that rests on the user's back when the pants are worn. Alternatively, the flap may extend around one or both hips, and/or along the front of the user. In some embodiments, having the flap extend across the back and around the hips of the pants to at least a portion of the front of the pants may give structural support to the flap to facilitate the flap staying adjacent the user's body when in the extended position.

In some embodiments, the height of the flap may vary over the length of the flap. For example, the flap may be highest in a middle portion of the flap, and the height may increase from ends of the flap toward the middle. In some embodiments, the height of the flap may increase linearly from the ends toward the middle portion. In other embodiments, the top edge of the flap may be curved and have a concave and/or convex shape as the height increases from the ends toward the middle portion.

In various embodiments, the height of the flap at its highest point may be such that a distance from the top edge of the flap to the top edge of the pants when the flap is in the folded up position is about one to twelve inches, or more particularly about two to six inches.

In various embodiments, the flap may be coupled to the pants at a seam to provide a hinge point for folding the flap up and/or down. In various embodiments, the flap may be coupled to the pants at the seam by a permanent coupling mechanism, such as stitching and/or adhesive. Alternatively, the flap may be coupled to the pants at the seam by a releasable coupling mechanism, such as a zipper, snaps, buttons, and/or hook and loop type fasteners (e.g. Velcro™). In these embodiments, the flap may be optionally coupled to the pants and extended when needed, and the flap may be folded down and/or completely removed when the flap is not needed. Similarly, in some embodiments in which the flap is coupled to the pants by a releasable coupling mechanism, the flap may be switched between the extended position and folded down position by detaching the flap from the pants, rotating the orientation of the flap by 180 degrees, and then reattaching the flap to the pants.

In some embodiments, the flap may be coupled to the pants in such a way as to bias the flap in the up and/or down position, and/or to facilitate rotating the flap about the hinge point. For example, the flap may include additional stitching to bias the flap in the up and/or down position.

In some embodiments, the waistband system may include one or more releasable fasteners, such as hook and loop type fasteners, snaps, and/or zippers, to releasably couple a portion of the flap to the interior surface of the pants to secure the flap in the extended position and/or folded down position. For example, a releasable fastener may couple an exterior surface of the flap (i.e., the side of the flap that faces outward from the user's body when the flap is folded up) to the interior surface of the pants, above the seam where the flap is coupled to the pants, to secure the flap in the folded up position. The releasable fastener may also prevent snow, water, and/or debris from becoming lodged between the flap and the pants. This may be particularly important in embodiments in which the flap is coupled to the pants below the waistline.

Additionally, or alternatively, a releasable fastener may couple an interior surface of the flap (i.e., the side of the flap that faces the user's body when the flap is folded up) to the interior surface of the pants, below the seam where the flap is coupled to the pants, to secure the flap in the folded down position. This may enhance the comfort to the user and/or may prevent/reduce the flap from sliding above the waistline when the flap is placed in the folded down position.

In various embodiments, the flap may be made of any desirable material and/or combination of materials. The flap may be made from the same and/or different materials as the pants. In some embodiments, the flap may be made partially or entirely of a waterproof and/or water-resistant material, which may also be breathable, e.g., a synthetic waterproof breathable material. The waterproof and/or water-resistant material may prevent water from penetrating the flap. In some embodiments, the flap may include a relatively elastic material, e.g. a material including a spandex component. The elastic material may enhance the fit of the flap around the body of the user, thereby improving comfort and/or enhancing the physical barrier against snow and/or water.

In various embodiments, the flap may include a material of sufficient rigidity so that the flap remains substantially upright when in the extended (folded up) position. In some embodiments, the flap may include a frame structure, such as comprising vertical ribs of rigid or semi-rigid material, to provide some rigidity for the flap to stand up.

In various embodiments, the flap may include multiple portions (also referred to as panels) of material coupled together. In some such embodiments, one or more of the portions may be of a different material than one or more other portions. For example, the flap may include one or more portions of elastic material coupled to one or more portions of waterproof material (e.g., waterproof breathable material), allowing the flap to conform to the body of the user while still being substantially waterproof. In various embodiments, the portions of different materials may be arranged in any configuration within the flap. For instance, in some embodiments, the elastic portion of the flap may be placed to enhance comfort and/or in areas where a tight fit is especially important and/or otherwise difficult to achieve because of the shape of the torso. In one, non-limiting example, the flap may include a middle portion of relatively elastic material in a central back region of the pants (the region disposed in the middle of the user's back when the pants are worn), and side portions of relatively waterproof material on either side of the elastic portion.

Although the waistband system may be particularly suited for use during snow activities, it is adaptable for any use where it is desired to protect the user's body and/or inner layer of clothing from outside elements. For example, the waistband may be adapted for use in the rain, during fishing for protecting against water, during construction or manual labor for protecting against dirt and/or debris, and/or for working with hazardous chemicals.

Figure 1C:
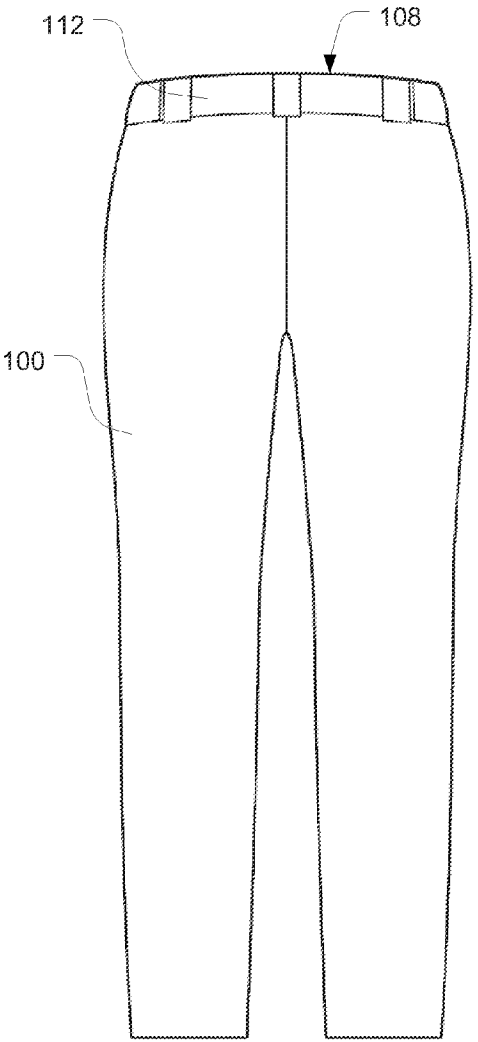
Figure 1B:
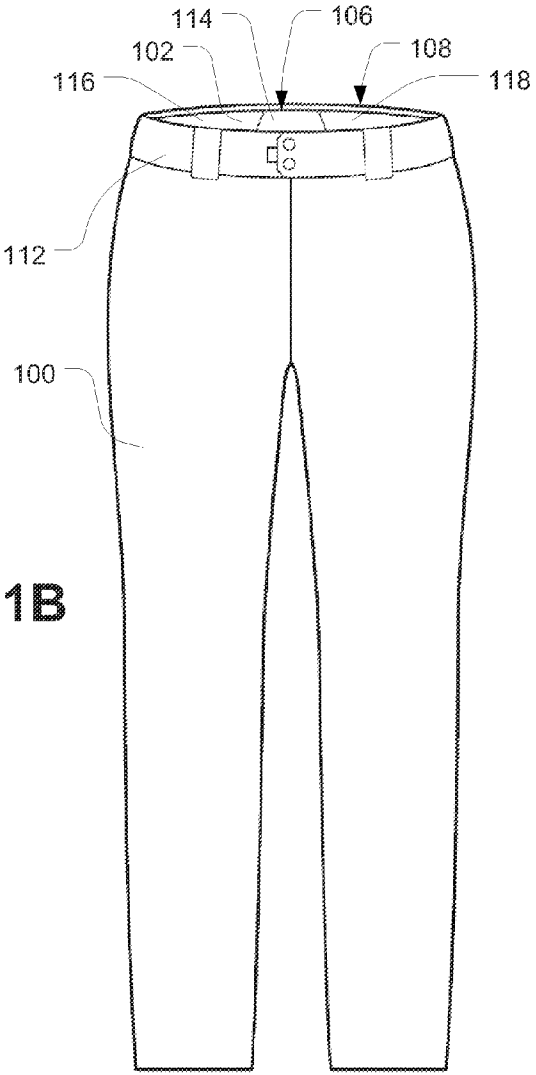
Figure 1D:
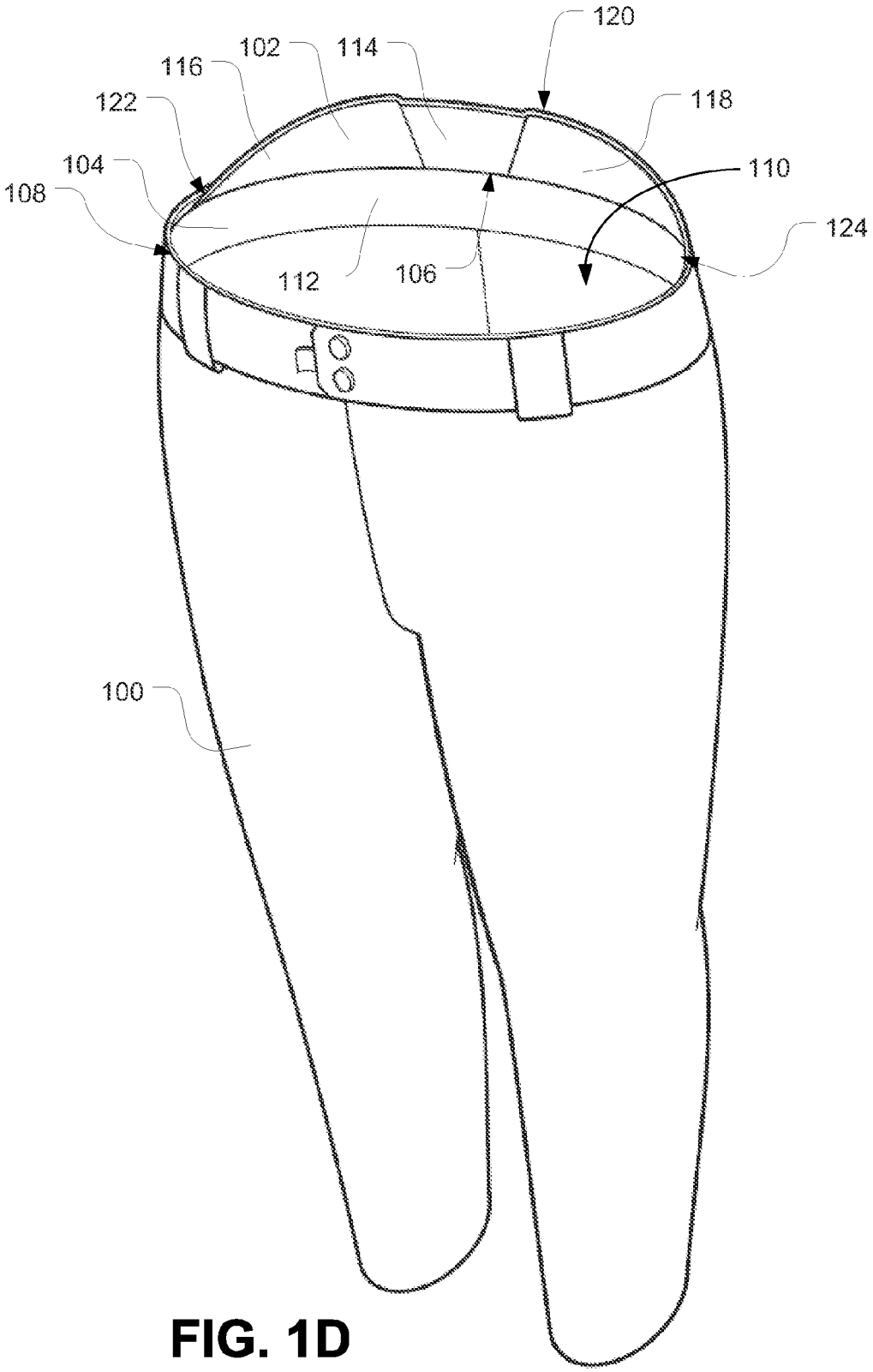
FIGS. 1D-I illustrate various views of the pants of FIGS. 1A-C with the flap of the fold-up waistband system in an extended position, including: (D) a perspective view; (E) a front view; (F) a rear view; (G) a left side view; (H) a right side view; and (I) a top view, in accordance with various embodiments.
Figure 1F:
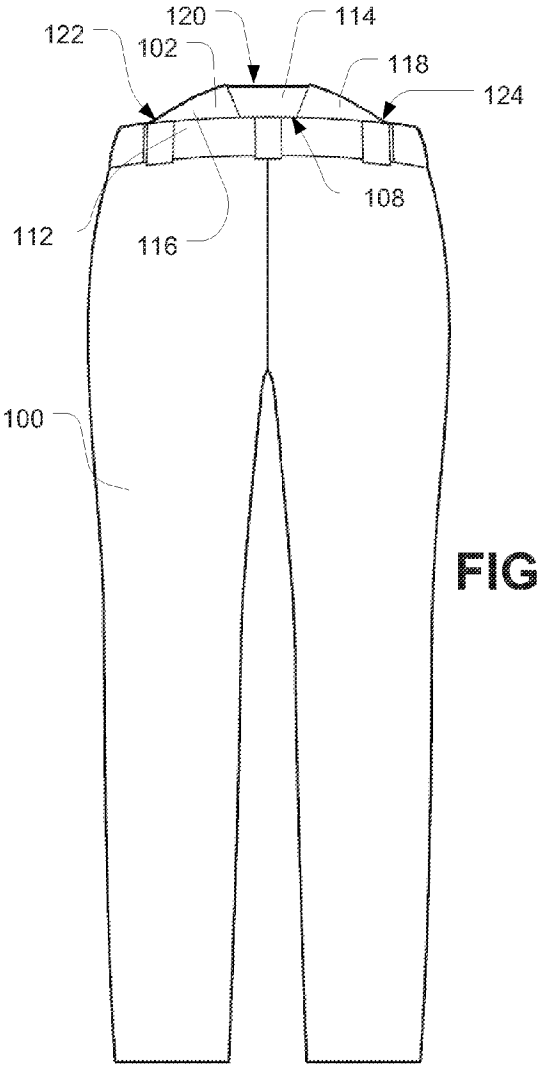
Figure 1E:
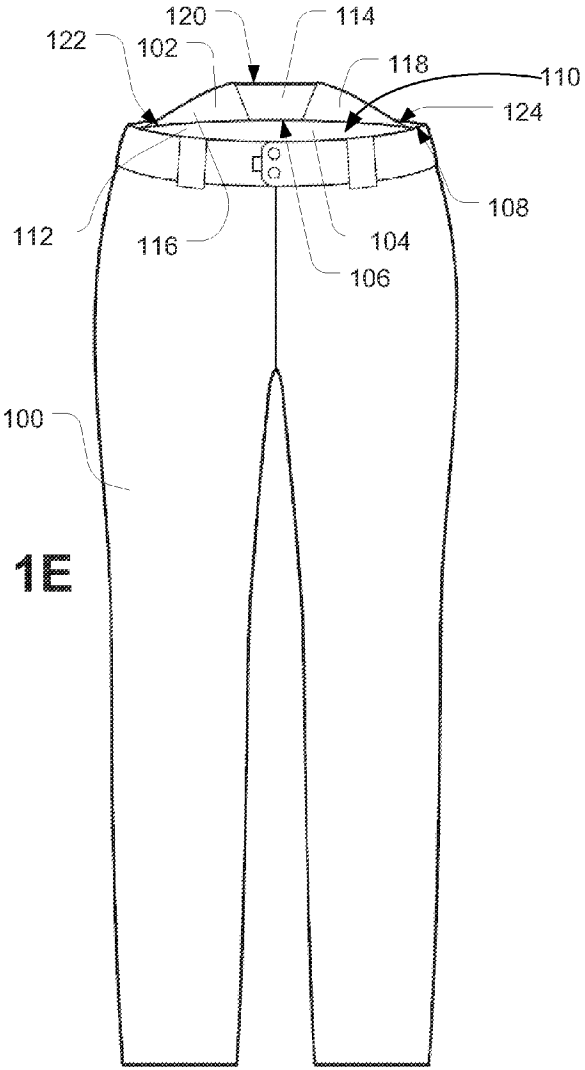
Figure 1G:
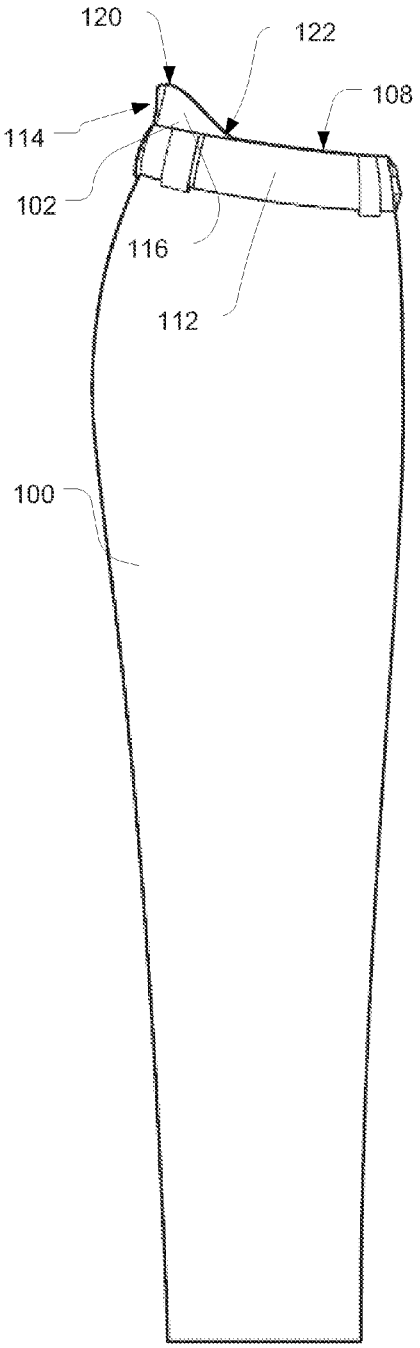
Figure 1H:
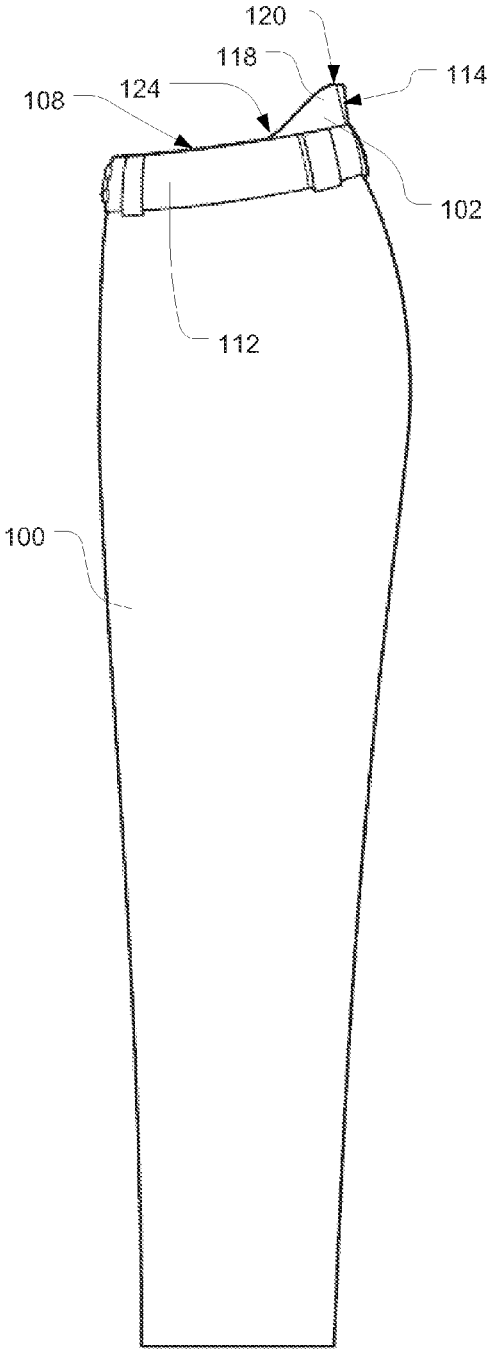
Figure 1I:
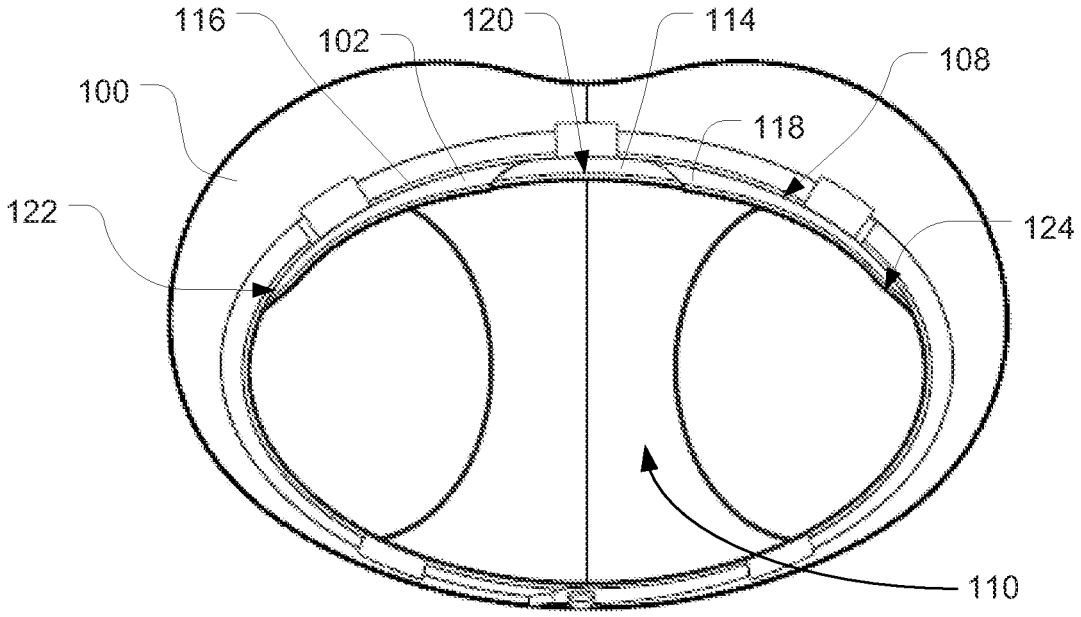

FIGS. 1A-I show an example of a pair of pants 100 with a flap 102 coupled to the pants 100, in accordance with various embodiments. Flap 102 is coupled to an interior surface 104 of pants 100 at a seam 106 adjacent a top edge 108 (also referred to as waistline 108) of pants 100. The flap 102 may be rotated about seam 106 between a folded down position (as shown in FIGS. 1A-C), and an extended position (as shown in FIGS. 1D-I). As shown in FIGS. 1A-C, the flap 102 is entirely disposed below the top edge 108 in an interior portion 110 of pants 100 when the flap 102 is in the folded down position. Accordingly, the flap 102 may be hidden from view when the pants are worn while the flap is in the folded down position. The folded down position of flap 102 may provide improved comfort to the user and/or aesthetic appeal compared with the folded up position. As shown in FIGS. 1D-I, when the flap 102 is in the extended position, the flap 102 extends above the top edge 108 of the pants. Accordingly, the folded up position may prevent/reduce matter, such as rain, snow, water, and/or debris, from reaching the interior portion 110 of the pants 100.

Although the flap 102 is shown in FIGS. 1A-I to be coupled to the pants 100 just below the top edge 108, in other embodiments, the flap 102 may be coupled at the top edge 108 and/or further below the top edge 108. As shown in FIGS. 1A-I, the pants 102 may include a waistband 112 that extends around the torso (e.g., waist) of a user when the pants are worn and defines the waistline (top edge) 108. In some embodiments, the flap 102 may be coupled to the waistband 112, at the top edge 108 of waistband 112, and/or below waistband 112.

Flap 102 includes a middle portion 114 coupled between side portions 116 and 118. In some embodiments, one or more of middle portion 114, side portion 116, and/or side portion 118 may be made of a different material than one or more other portions. For example, middle portion 114 may be made of a relatively elastic material, and side portions 116 and 118 may be made of a relatively waterproof material (e.g., a waterproof breathable material). In other embodiments, middle portion 114 and side portions 116 and 118 may all be made of the same material.

Flap 102 has a substantially trapezoidal shape. A height of the flap 102 between a top edge 120 of flap 102 and the seam 106 is substantially constant over middle portion 114. The top edge 120 tapers down with a slightly concave shape as it moves away from middle portion 114 toward ends 122 and 124 of flap 102. A length of the flap 102 between ends 122 and 124 along seam 106 is slightly less than half of the circumference of waistline 108 (as shown, the length of the flap 102 is about 40% of the circumference of the waistline). The flap 102 is centered on a back side of pants 100 to cover a portion of the user's back when the flap 102 is in the extended position.

FIGS. 2A-G illustrate a pair of pants 200 with a flap 202 coupled to the pants 200, in accordance with various embodiments. The pants 200 and flap 202 include similar features to pants 100 and flap 102, respectively, as shown in FIGS. 1A-I and described above. Flap 202 is coupled to an interior surface 204 of pants 200 at a seam 206. The flap 202 is coupled to a waistband 212, below a top edge 208 (also referred to as waistline 208).

Figure 2A:
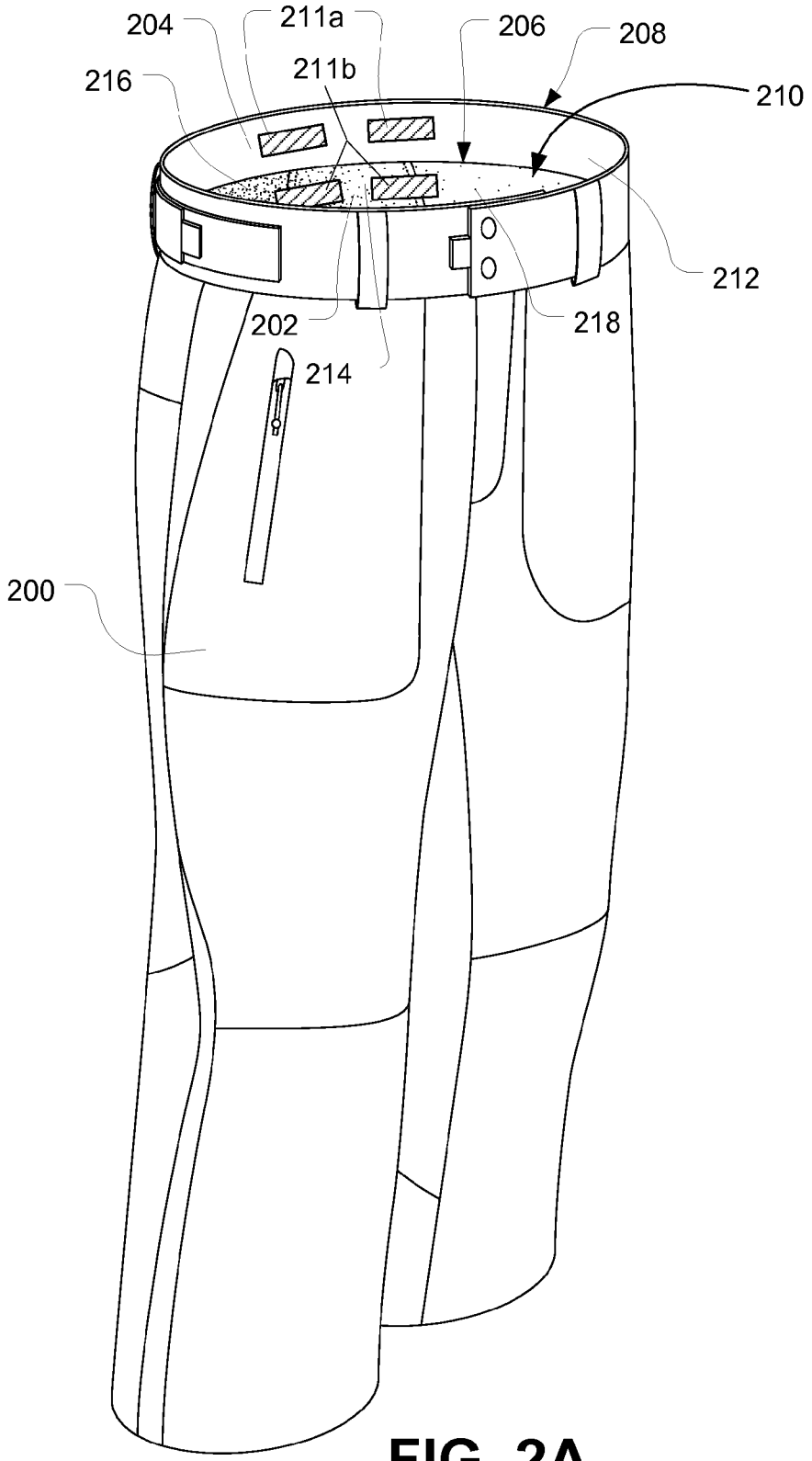
FIG. 2A illustrates a perspective view of an example of a pair of pants including a fold-up waistband system with a flap of the fold-up waistband system in a folded down position, in accordance with various embodiments.
Figure 2B:
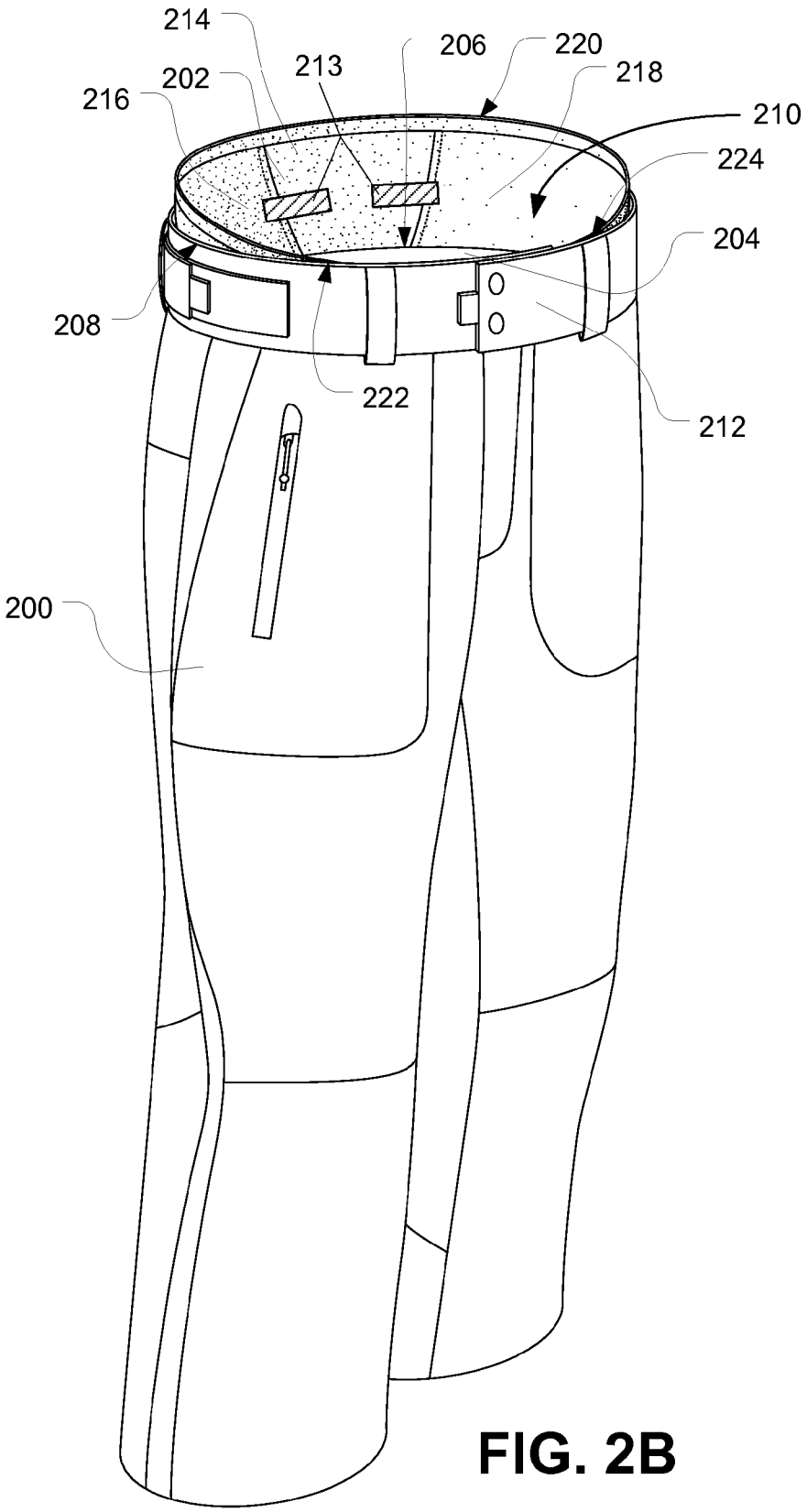
FIGS. 2B-G illustrate various views of the pants of FIG. 2A with the flap of the fold-up waistband system in an extended position, including: (B) a perspective view; (C) a front view; (D) a rear view; (E) a left side view; (F) a right side view; and (G) a top view, in accordance with various embodiments.
Figure 2C:
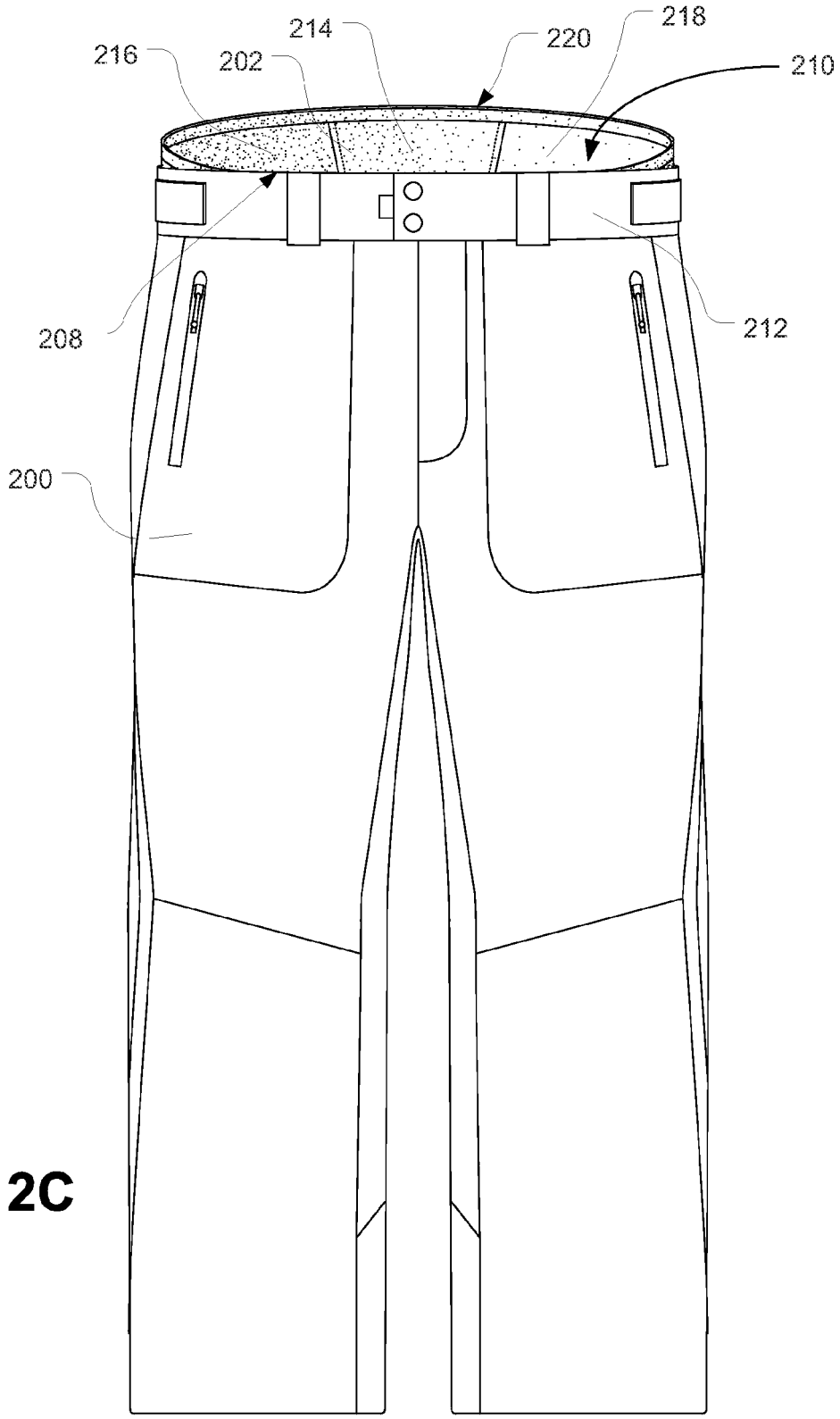
Figure 2D:
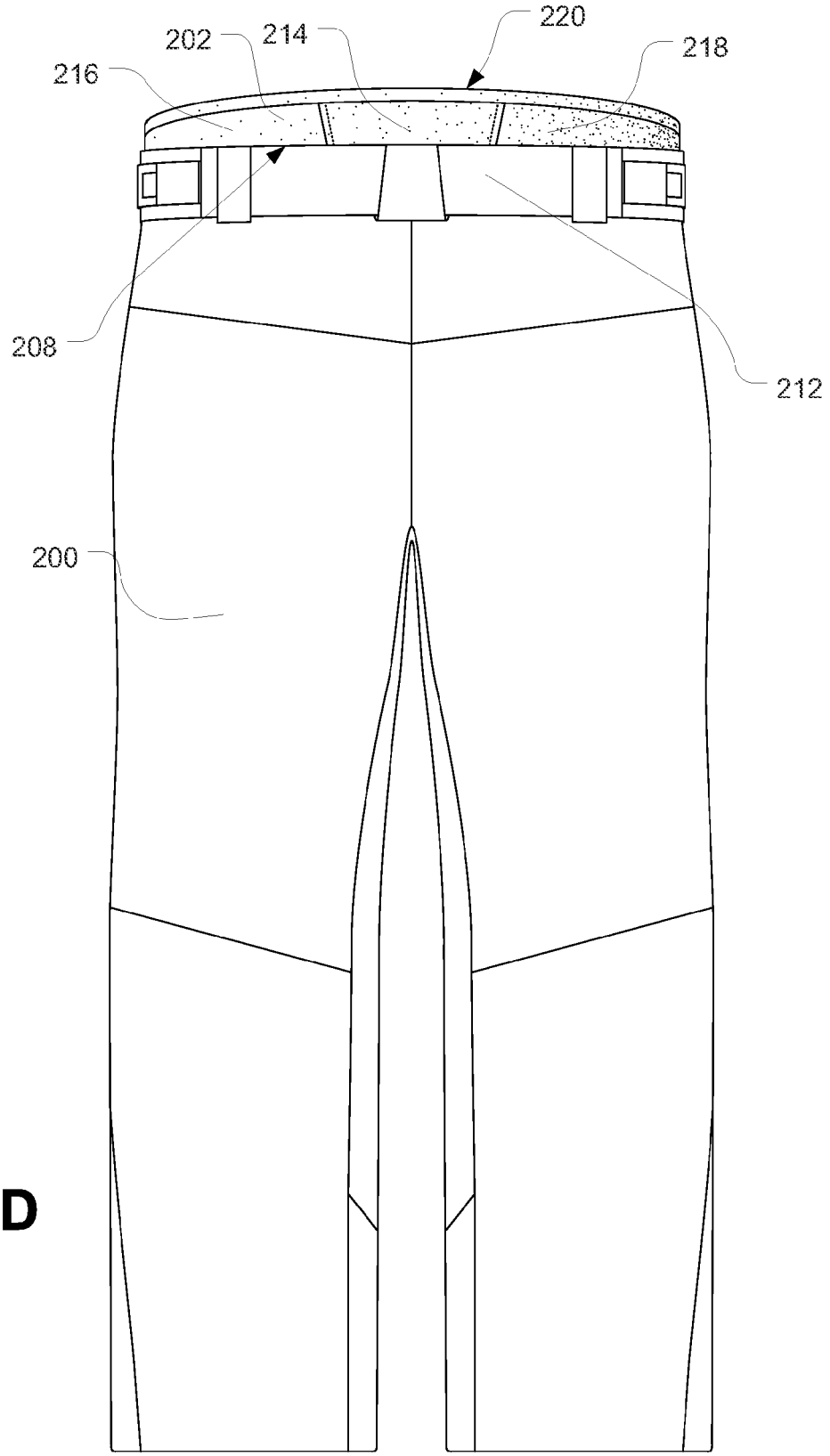
Figure 2E:
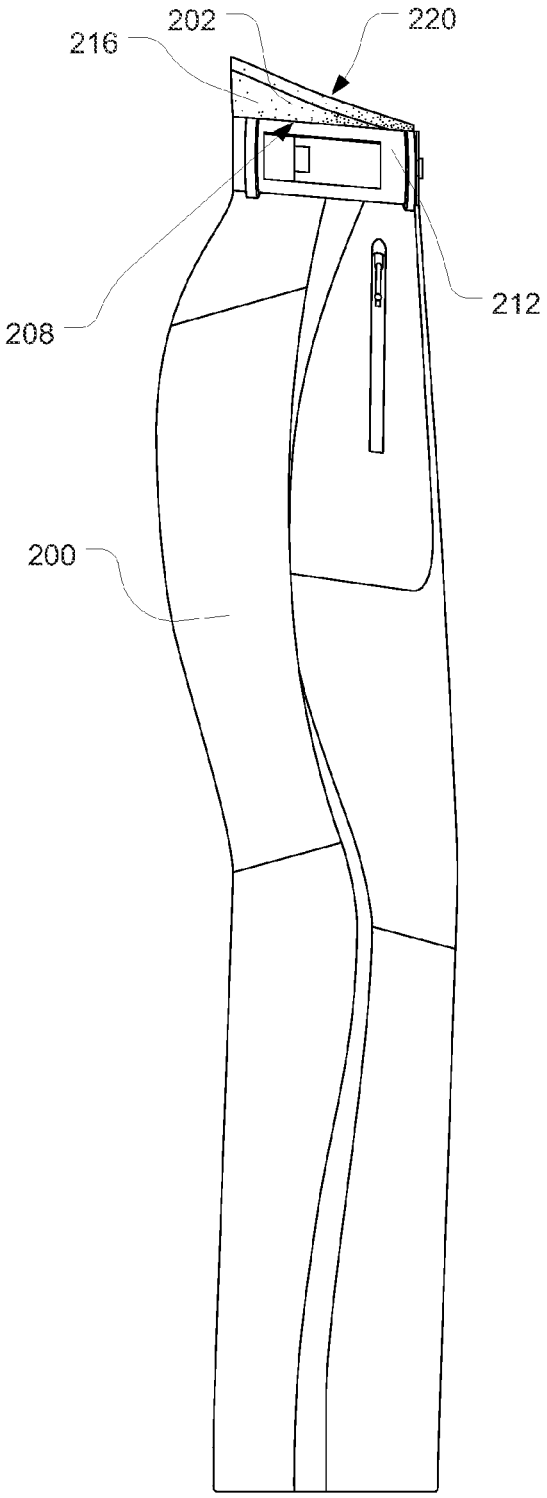
Figure 2F:
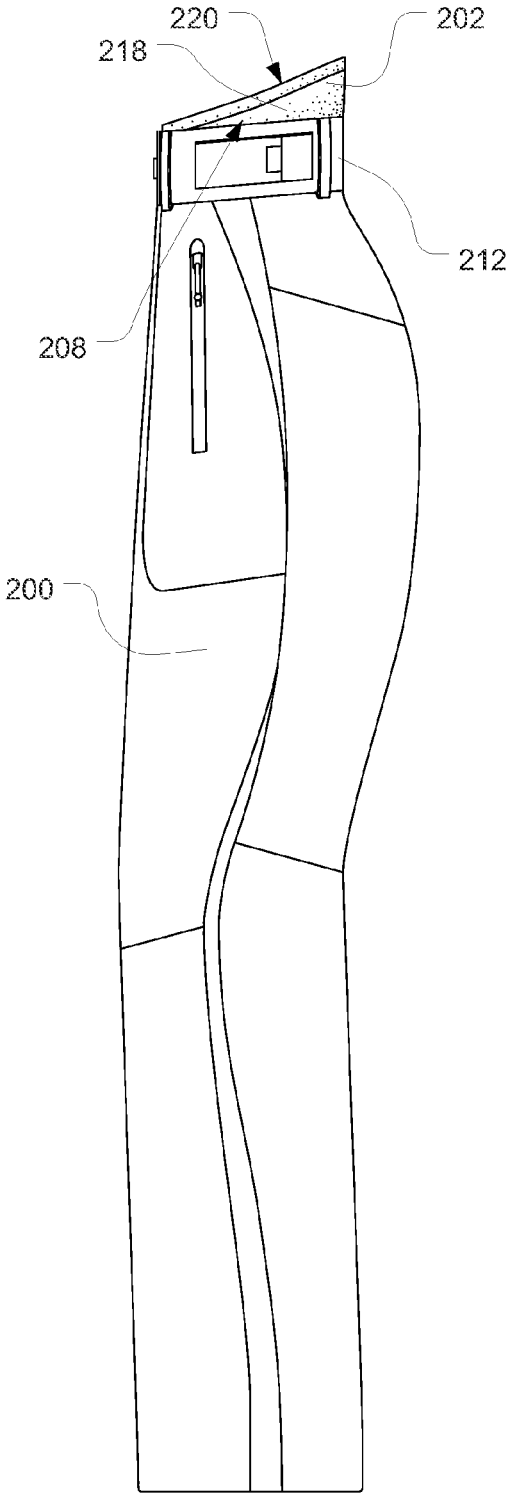
Figure 2G:
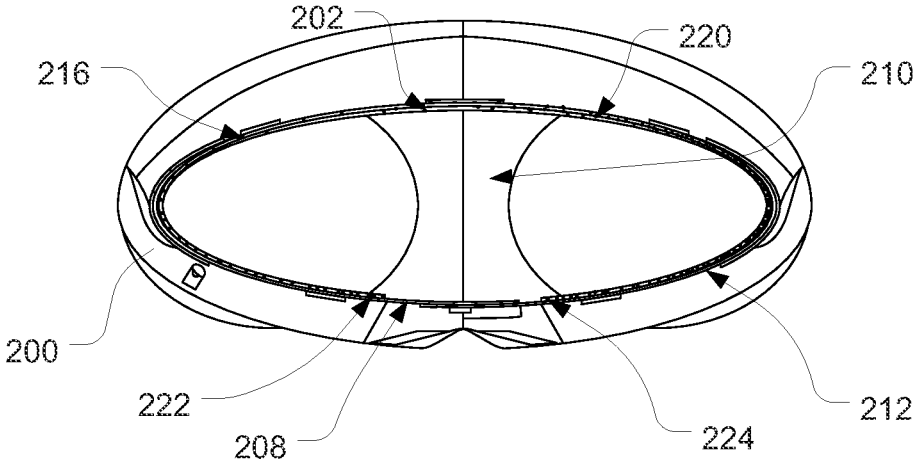

The flap 202 may be rotated about seam 206 between a folded down position (as shown in FIG. 2A), and an extended (folded up) position (as shown in FIGS. 2B-G). As shown in FIG. 2A, the flap 202 is entirely disposed below the top edge 208 in an interior portion 210 of pants 200 when the flap 202 is in the folded down position. Accordingly, the folded down position of flap 202 may provide improved comfort to the user and/or aesthetic appeal compared with the extended position. As shown in FIGS. 2B-G, when the flap 202 is in the extended position, the flap 202 extends above the top edge 208 of the pants. Accordingly, the extended position may prevent/reduce matter, such as rain, snow, water, and/or debris, from reaching the interior portion 210 of the pants 200. Further, one or more releasable fasteners 211*a* and 211*b* may be provided to couple the exterior surface of flap 202 to the interior surface of pants 200 above seam 206 when flap 202 is in the folded up position.

Having the flap 202 coupled to the pants 200 below the waistline 208 may facilitate maintaining the flap 202 below the waistline 208 of the pants when in the folded down position. Additionally, the flap coupled below the waistline 208 may facilitate maintaining the flap 202 against the user's body when the flap is in the extended position, since a lower portion of the flap 202 will be held against the user's body by the waistband 212 of the pants. Further, one or more releasable fasteners 213 may be provided to couple the interior surface of flap 202 to the interior surface of pants 200 below seam 206 when flap 202 is in the folded down position.

Flap 202 includes a middle portion 214 coupled between side portions 216 and 218. In some embodiments, middle portion 214 and side portions 216 may all be made of the same material. In other embodiments, one or more of middle portion 214, side portion 216, and/or side portion 218 may be made of a different material than one or more other portions. For example, middle portion 214 may be made of a relatively elastic material, and side portions 216 and 218 may be made of a relatively waterproof material (e.g., a waterproof breathable material). In other embodiments, middle portion 214 and side portions 216 and 218 may all be made of the same material.

Flap 202 has a top edge 220 with a generally rounded and slightly convex shape. A height of flap 202 between the top edge 220 of flap 202 and the seam 206 is greatest in the middle and gradually decreases as the top edge 220 moves toward ends 222 and 224. A length of the flap 202 between the ends 222 and 224 along seam 206 is less than the circumference of waistline 208 but greater than half the circumference of waistline 208 (as shown, the length of the flap 202 is about 80% of the circumference of the waistline 208). Flap 202 is centered on the back side of pants 200 so that the ends 222 and 224 are disposed in a front portion of pants 200. This orientation of the flap 202, with portions of the flap extending around the hips toward the front of the user, may facilitate maintaining the flap close to the body of the user along the user's back.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of the present disclosure. Those with skill in the art will readily appreciate that embodiments may be implemented in a very wide variety of ways. This application is intended to cover any adaptations or variations of the embodiments discussed herein. Therefore, it is manifestly intended that embodiments herein be limited only by the claims and the equivalents thereof.

What is claimed is:

1. An apparatus, comprising:

pants configured to be worn by a user and having a top edge that defines a waistline; and a flap of material permanently coupled to the pants at a seam below the waistline and configured to rotate about the seam between a folded up position, in which a portion of the flap extends above the waistline of the pants, and a folded down position in which the flap is completely disposed in an interior portion of the pants below the waistline; and wherein a length of the flap along the seam is less than a circumference of the waistline.

2. An apparatus, comprising:

pants configured to be worn by a user and having a top edge that defines a waistline; and a flap of material permanently coupled to the pants at a seam below the waistline and configured to rotate about the seam between a folded up position, in which a portion of the flap extends above the waistline of the pants, and a folded down position in which the flap is completely disposed in an interior portion of the pants below the waistline, wherein the flap includes a plurality of panels coupled together, one or more of the panels being of a different material than one or more of the other panels; and wherein a length of the flap along the seam is less than a circumference of the waistline.

3. The apparatus of claim 2, wherein the flap includes a middle panel coupled between side panels, the middle panel including an elastic material, and the side panels including a waterproof material.

4. An apparatus, comprising:

pants configured to be worn by a user and having a top edge that defines a waistline;

a flap of material permanently coupled to the pants at a seam below the waistline and configured to rotate about the seam between a folded up position, in which at least a portion of the flap extends above the waistline of the pants, and a folded down position in which the flap is substantially or completely disposed in an interior portion of the pants below the waistline; and a releasable fastener configured to couple an exterior surface of the flap to the interior surface of the pants above the seam when the flap is in the folded up position.

5. An apparatus, comprising:

pants configured to be worn by a user and having a top edge that defines a waistline; and a flap of material permanently coupled to the pants at a seam below the waistline and configured to rotate about the seam between a folded up position, in which a portion of the flap extends above the waistline of the pants, and a folded down position in which the flap is completely disposed in an interior portion of the pants below the waistline, wherein a length of the flap along the seam is less than or equal to half of a circumference of the top edge of the pants, and the flap is centered on a back side of the pants configured to rest against a back of the user.

6. An apparatus, comprising:

pants configured to be worn by a user and having a top edge that defines a waistline; and a flap of material permanently coupled to the pants at a seam below the waistline and configured to rotate about the seam between a folded up position, in which a portion of the flap extends above the waistline of the pants, and a folded down position in which the flap is completely disposed in an interior portion of the pants below the waistline, wherein a length of the flap along the seam is less than a circumference of the waistline, wherein a length of the flap along the seam is greater than half of a circumference of the top edge of the pants, and the flap is centered on a back side of the pants configured to rest against a back of the user.

7. An apparatus comprising:

pants configured to be worn by a user and having a top edge that defines a waistline; and a flap of material permanently coupled to the pants at a seam below the waistline and configured to rotate about the seam between an extended position, in which a portion of the flap rises above the waistline of the pants, and a folded down position in which the flap is completely disposed in an interior portion of the pants below the waistline;

wherein the flap is centered on a back side of the pants, a length of the flap along the seam is less than a circumference of the waistline, and a height of the flap is greatest at a middle portion of the flap and tapers down from the middle portion.

8. The apparatus of claim 7, wherein the flap includes a plurality of panels coupled together, one or more of the panels being of a different material than one or more of the other panels.

9. The apparatus of claim 7, wherein the length of the flap is less than or equal to half of the circumference of the waistline.

10. The apparatus of claim 1, wherein the seam is located at or below a lower edge of a waistband of the pants.

11. The apparatus of claim 1, wherein the flap is sufficiently rigid such that it remains substantially upright when in the folded up position.

12. The apparatus of claim 4, wherein the releasable fastener is a first releasable fastener, and wherein the apparatus further comprises:

a second releasable fastener coupled to the interior surface of the pants and configured to interact with the first releasable fastener to support the flap when it is in the folded up position.

13. The apparatus of claim 1, wherein the flap of material is permanently coupled to the pants by stitching or adhesive.

14. The apparatus of claim 2, wherein the flap of material is permanently coupled to the pants by stitching or adhesive.

15. The apparatus of claim 4, wherein the flap of material is permanently coupled to the pants by stitching or adhesive.

16. The apparatus of claim 5, wherein the flap of material is permanently coupled to the pants by stitching or adhesive.

17. The apparatus of claim 6, wherein the flap of material is permanently coupled to the pants by stitching or adhesive.

18. The apparatus of claim 7, wherein the flap of material is permanently coupled to the pants by stitching or adhesive.

* * * * *